US007161610B2

(12) United States Patent
Ikeda

(10) Patent No.: US 7,161,610 B2
(45) Date of Patent: Jan. 9, 2007

(54) THERMAL PRINTER WITH CLEANING DEVICE AND CLEANING METHOD FOR THERMAL HEAD

(75) Inventor: Akira Ikeda, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 165 days.

(21) Appl. No.: 11/050,800

(22) Filed: Feb. 7, 2005

(65) Prior Publication Data

US 2005/0174422 A1 Aug. 11, 2005

(30) Foreign Application Priority Data

Feb. 6, 2004 (JP) ..... 2004-031132

(51) Int. Cl.
*B41J 29/17* (2006.01)

(52) U.S. Cl. ..... 347/171

(58) Field of Classification Search ..... 347/171, 347/218, 222; 400/120.01, 701; 101/425
See application file for complete search history.

(56) References Cited

U.S. PATENT DOCUMENTS 6,249,303 B1 * 6/2001 Mochizuki et al. ..... 347/222
6,985,167 B1 * 1/2006 Lien ..... 347/218
2005/0084315 A1 * 4/2005 Lodwig et al. ..... 400/701

FOREIGN PATENT DOCUMENTS

JP 5-138992 A 6/1993

* cited by examiner

*Primary Examiner*—K. Feggins
(74) *Attorney, Agent, or Firm*—Sughrue Mion, PLLC

(57) ABSTRACT

A cleaning roller and a platen roller are provided in a first rotating plate which rotates around a main shaft. The cleaning roller and the platen roller are disposed at an equal distance from the main shaft. In printing, the platen roller is positioned at a facing position to face the thermal head. In cleaning the thermal head, the rotating plate rotates to retract the platen roller from the facing position, and then the cleaning roller is positioned at the facing position in place of the platen roller. The foreign matters on the thermal head are scraped off by rotating the cleaning roller in a state that the cleaning roller is contacted with the thermal head.

18 Claims, 5 Drawing Sheets

THERMAL PRINTER WITH CLEANING DEVICE AND CLEANING METHOD FOR THERMAL HEAD

BACKGROUND OF THE INVENTION

1. Field of the Invention

The present invention relates to a cleaning device and a cleaning method for a thermal printer.

2. Description of the Prior Arts

There has been known a thermal printer in which an image is thermally recorded by heating a thermal head. A platen roller is disposed at a position of facing the thermal head. In the thermal printer, there are a thermal recording type (a thermal printer) using a thermal recording paper (hereinafter referred to as a recording paper) and a thermal transfer type using an ink ribbon for transferring. In the thermal printer, the recording paper is sandwiched between the thermal head and the platen roller so that the thermal head presses the recording paper to thermally record the image on the recording paper being fed.

Since the thermal head is heated to a high temperature, a protective layer of a surface of the recording paper is softened, so that a part of the protective layer is adhered to the thermal head as foreign matters leading to deterioration of the image. The thermal head is cleaned in order to remove the foreign matters. In Japanese Patent Laid-Open Publications No. 5-138992, a cleaning sheet on which a polishing material is applied is fed to the printer instead of the recording paper. When the cleaning sheet passes on the thermal head through a feeding path, it scrapes the foreign matters adhered to the thermal head.

However, in the cleaning method using the cleaning sheet, a user has to load the cleaning sheet in the printer. Although it is ideal that the thermal head is regularly cleaned, the loading operation for the cleaning sheet is troublesome, so that the user is apt to neglect the cleaning.

SUMMARY OF THE INVENTION

An object of the present invention is to provide a thermal printer in which a thermal head can be cleaned without requiring a loading operation for a cleaning sheet, and a cleaning method for the thermal head.

In order to achieve the above object, a thermal printer of the present invention is provided with a thermal head for thermally recording an image by applying heat to a recording material, a platen roller for supporting the recording material at a facing position to face the thermal head, a cleaning roller for cleaning the thermal head by rotating in a state that the outer peripheral surface thereof is in contact with the thermal head at the facing position, a roller driving mechanism for driving the cleaning roller, and a shifting mechanism for selectively positioning either one of the platen roller and the cleaning roller at the facing position by shifting both of rollers.

According to the preferred embodiment of the present invention, the shifting mechanism includes first and second rotating plates for holding both ends of the platen roller and the cleaning roller and a main shaft to which the first and second rotating plates are attached. The first and second rotating plates rotate around the main shaft. The cleaning roller is held by the first and second rotating plates in a detachable manner. Either polishing agents are applied on an outer peripheral surface of the cleaning roller, or the outer peripheral surface has a brush-like shape.

According to a cleaning method for a thermal head of the present invention, a platen roller is retracted from a facing position of facing the thermal head to position the cleaning roller at the facing position. The thermal head is cleaned by rotating the cleaning roller by a roller shifting mechanism in a state that the cleaning roller is in contact with the thermal head. The cleaning is performed automatically at a predetermined timing, such as at the time when printed sheet number reaches a predetermined number, or when the thermal printer is powered on.

According to the present invention, the shifting mechanism for selectively positioning either one of the platen roller and the cleaning roller at the facing position to face the thermal head is provided, so that it becomes possible to clean the thermal head without requiring the loading operation for the cleaning sheet. In addition, since the cleaning roller is automatically positioned at the facing position at the predetermined timing by the shifting mechanism, a user does not need to manage the time when the cleaning is performed.

BRIEF DESCRIPTION OF THE DRAWINGS

The above and other subjects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE PREFERRED EMBODIMENTS

Figure 1:
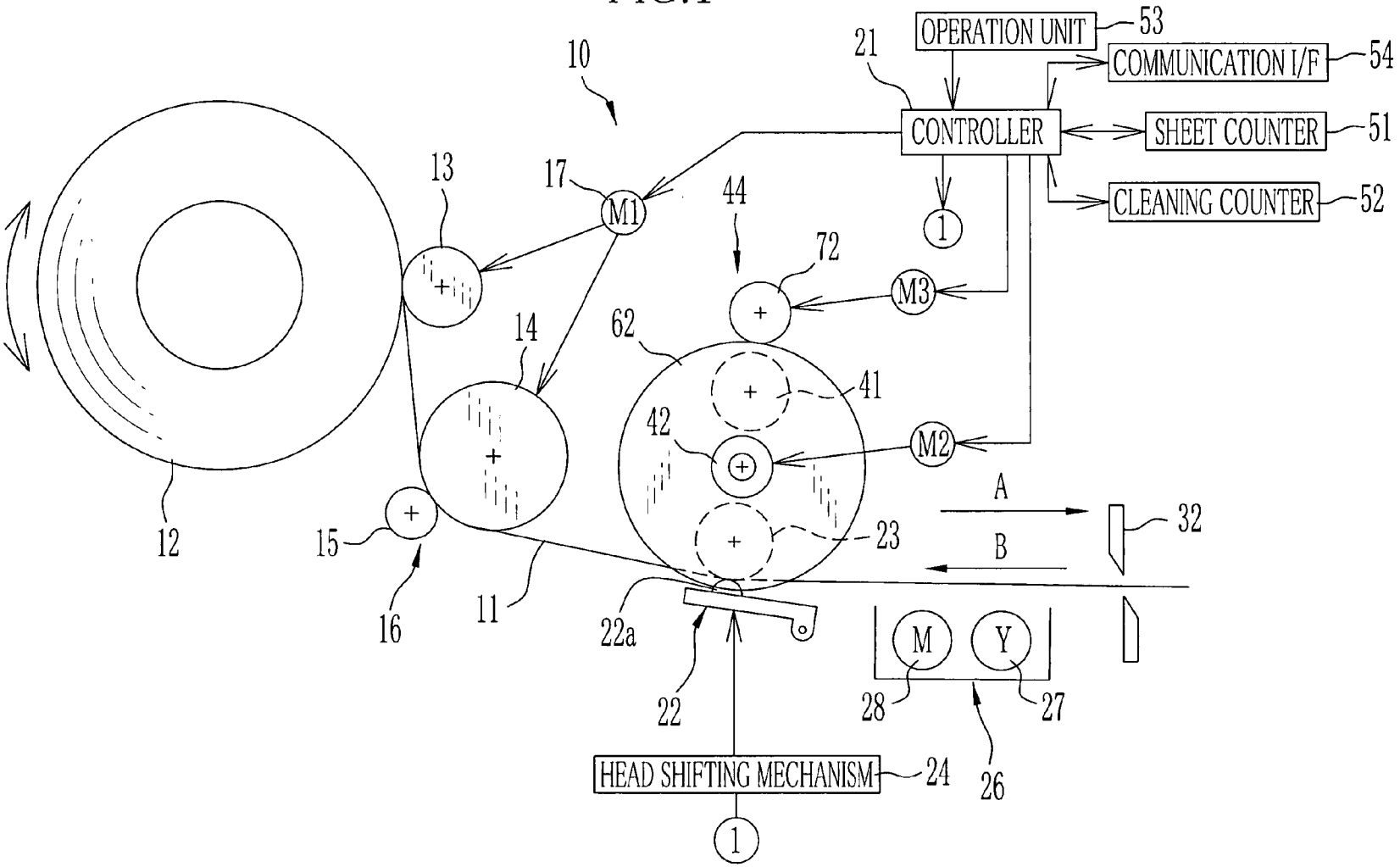
FIG. 1 is a schematic view showing constitution of a color thermal printer of the present invention.

As shown in FIG. 1, a continuous recording paper 11 wound into a roll shape is loaded in a color thermal recording printer 10 as a recording paper roll 12. The recording paper 11 includes a cyan thermosensitive coloring layer, a magenta thermosensitive coloring layer and a yellow thermosensitive coloring layer overlaid on a support in sequence. The yellow thermosensitive coloring layer which is the farthest from the support has the highest heat sensitivity and develops the yellow color by application of relatively low heat energy. The cyan thermosensitive coloring layer, which is the closest to the support, has the lowest heat sensitivity and develops the cyan color by application of relatively high heat energy. The yellow thermosensitive coloring layer loses its coloring ability when yellow fixing light which is violet-blue visible light of a light-emitting wavelength peaking at about 420 nm are applied thereto. The magenta thermosensitive coloring layer develops the magenta color with heat energy in between for coloring the yellow and cyan thermosensitive coloring layers, and loses its coloring ability when near-ultraviolet rays of the light-emitting wavelength peaking at about 365 nm are applied thereto.

A front end of the recoding paper 11 is drawn into a feeding path from the recording paper roll 12 by rotating the recoding paper roll 12 after a supply roller 13 has been in contact with the recording paper roll 12. A feed roller pair 16 constituted of a capstan roller 14 and a pinch roller 15 is disposed on the downstream side of the supply roller 13. The recording paper 11 is fed in a feeding direction (A direction) and a withdrawing direction (B direction) by being nipped by the feed roller pair 16. The feeding path is constituted of a guide member (not shown).

The supply roller 13 and the feed roller pair 16 are driven to rotate in both forward and backward directions by a feed motor M1. The rotation speed and the rotation amount of the feed motor M1 are controlled by a controller 21 through a motor driver (not shown). As the feed motor M1, a stepping motor whose rotation amount is determined according to pulse number from the controller 21 is used, for example. The controller 21 specifies the position of the recording paper 11 including a record-starting position, and a cutting position and the feeding amount of the recording paper 11 by counting driving pulses to supply to the feed motor M1.

A thermal head 22 is disposed on the downstream side of the feed roller pair 16. The thermal head 22 includes a heating element array 22*a* in which a large number of heating elements are arranged in a main scanning direction, and supplies heat energy according to a gradation value of image data to the recording paper 11 by heating each heating element in a state that heating element array 22*a* is pushed against the recording paper 11. The thermal head 22 is driven by a head driver based on the image data sent from the controller 21.

A platen roller 23 for supporting the recoding paper 11 from the rear surface thereof is disposed at a facing position to face the heating element array 22*a*. The platen roller 23 is rotated in accordance with feeding of the recording paper 11 to stabilize a contact state between the recording paper 11 and the heating element array 22*a*. The recording paper 11 is held between the thermal head 22 and the platen roller 23 to be pushed against the heating element array 22*a*. After a recording area of the recording paper 11 has passed through the thermal head 22 in feeding the recording paper 11, the image is thermally recorded by the thermal head 22 with feeding the recording paper 11 in the B direction.

A head shifting mechanism 24 is swung between a retracted position to generate a gap between the heating element array 22*a* and the platen roller 23, and a pressing position to press the heating element array 22*a* against the recording paper 11. In feeding the recording paper 11, the thermal head 22 is positioned at the retracted position, so that the feeding path for the recording paper 11 is ensured between the heating element array 22*a* and the platen roller 23. When recording the image, the thermal head 22 is moved to the pressing position to push the heating element array 22*a* against the recording paper 11.

An optical fixer 26 is disposed on the downstream side in the A direction of the thermal head 22. The optical fixer 26 is provided with a yellow fixing lamp 27 emitting yellow fixing light and a magenta fixing lamp 28 emitting magenta fixing light. After a yellow image has been thermally recorded, the yellow fixing lamp 27 is turned on to optically fix the yellow image with feeding the recording area in the A direction. After that, a magenta image is started to be thermally recorded with feeding the recording area in the B direction. In this time, the yellow fixing lamp 27 is turned off. After thermally recording of the magenta image, the magenta fixing lamp 28 is turned on, and then the magenta image is started to be optically fixed with feeding the recording area in the A direction. After the recording area has passed through the optical fixer 26, the recording area is reversed to the B direction such that a cyan image is thermally recorded on the recording area.

A cutter 32 is disposed on the downstream side of the optical fixer 26. The cutter 32 is operated to cut the portion of the recording paper 11, which has been thermally recorded and fixed, into a sheet. The sheet is discharged from a delivery opening. The unrecorded portion of the recording paper 11 is withdrawn to the recording paper roll 12.

A cleaning roller 41 for cleaning the thermal head 22 is provided in a main body of the printer 10. The cleaning roller 41 is a cylindrical shape extending in the main scanning direction having approximately the same length as the heating element array 22*a* and the platen roller 23. Polishing agents are applied on an outer peripheral surface of the cleaning roller 41.

When the thermal head 22 is cleaned, the cleaning roller 41 is moved to the facing position in place of the platen roller 23. In the facing position, the outer peripheral surface of the cleaning roller 41 contacts with the heating element array 22*a*. The cleaning roller 41 is rotated in this state to rub its outer peripheral surface against the heating element array 22*a*, so that the foreign matters adhered to the heating element array 22*a* are scraped off.

The cleaning roller 41 is driven to be rotated by a cleaning motor M2 through a driving gear 42. A roller shifting mechanism 44 shifts both the platen roller 23 and the cleaning roller 41 to selectively position one of these two rollers at the facing position by interlocking them to be displaced. Namely, when printing, the platen roller 23 is moved to the facing position, while when cleaning the thermal head 22, the platen roller 23 is retracted from the facing position, and then the cleaning roller 41 is moved to the facing position in place of the platen roller 23. The roller shifting mechanism 44 is driven by a shifting motor M3.

A sheet counter 51 for counting the printed sheet number is connected with the controller 21. When the predetermined printed sheet number is counted, an operating mode of the printer 10 is automatically changed from a print mode to a cleaning mode. Once the operating mode has been changed to the cleaning mode, the sheet counter 51 is reset, and then the printed sheet number is started to be counted again.

In the cleaning mode, the roller shifting mechanism 44 shifts the cleaning roller 41 to the facing position to start the cleaning. In the present embodiment, when the printed sheet number reaches the predetermined number, the cleaning is automatically performed; however, when the printer 10 is powered on, the cleaning may be automatically performed.

In addition, a cleaning button is provided in an operation unit 53. The user can perform the cleaning treatment in any timing by depressing the cleaning button. Moreover, the cleaning may be performed by instructions from a host computer such as a personal computer through a communication I/F 54 for connecting communicably with the host computer.

Since the cleaning roller 41 is worn away, it is attached to the roller shifting mechanism 44 in a detachable manner so as to be exchanged. A cleaning counter 52 counts the number of the cleaning. The controller 21 gives warning that the cleaning roller 41 should be exchanged through a display and the like provided in the main body of the printer 10 when the count number of the cleaning counter 52 reaches the predetermined number.

Figure 2:
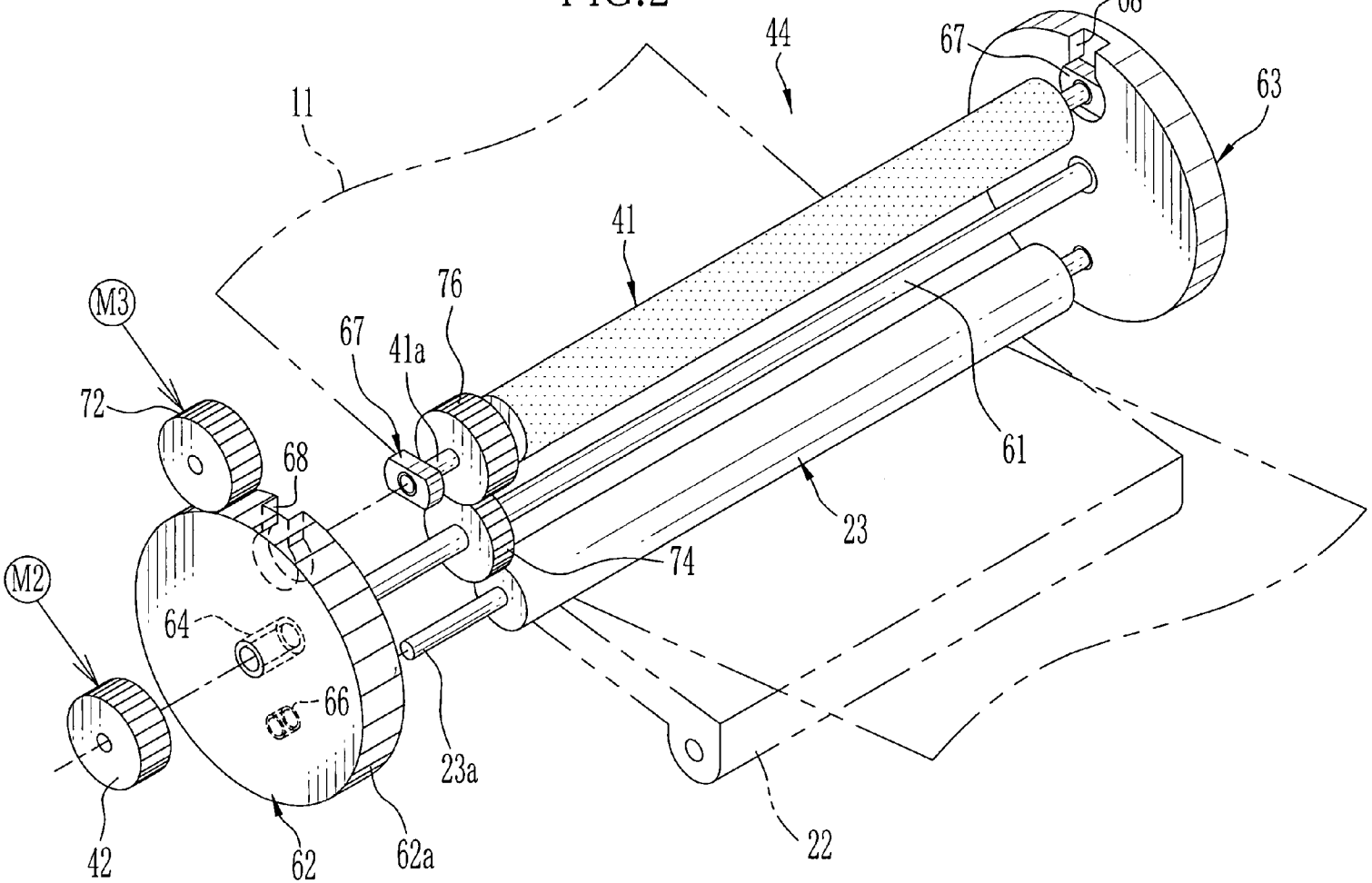
FIG. 2 is a perspective view showing constitution of a roller shifting mechanism.

As shown in FIG. 2, the roller shifting mechanism 44 has a main shaft 61 and first and second rotating plates 62, 63 having a disk-shape. The opposite ends of the main shaft 61 are inserted into each center of the rotating plates 62, 63. A bearing 64 is provided between each end of the main shaft 61 and each of the rotating plates 62, 63, so that the main shaft 61 is rotatable around the shaft. The opposite ends of the main shaft 61 penetrating into the rotating plates 62, 63 are attached to a chassis of the main body of the printer 10 to be held.

The cleaning roller 41 and the platen roller 23 are attached to the first and second rotating plates 62, 63 in parallel with the main shaft 61. And each of the rollers 41, 23 is disposed so as to be separated at an equal distance from the main shaft 61. Since an arrangement angle formed between the main shaft 61 and the shafts of the cleaning roller 41 and the platen roller 23 is 180 degrees, the rotating plates 62, 63 are rotated by 180 degrees around the main shaft 61, so that the roller to be positioned at the facing position is changed.

Opposite ends of a rotating shaft 23*a* of the platen roller 23 are respectively attached to the first and second rotating plates 62, 63 through a bearing 66, as in the case of the main shaft 61.

A bearing member 67 is provided in an end of a rotating shaft 41*a* of the opposite ends of the cleaning roller 41. An attachment portion 68 in which the bearing member 67 is fitted is formed in the first and second rotating plates 62, 63. The cleaning roller 41 is held detachably by the rotating plates 62, 63 by fitting the bearing member 67 in the attachment portion 68. A bearing 69 (see FIG. 3) is attached between the rotating shaft 41*a* and the bearing member 67, so that the rotating shaft 41*a* is rotatable around the shaft.

Figure 3A:
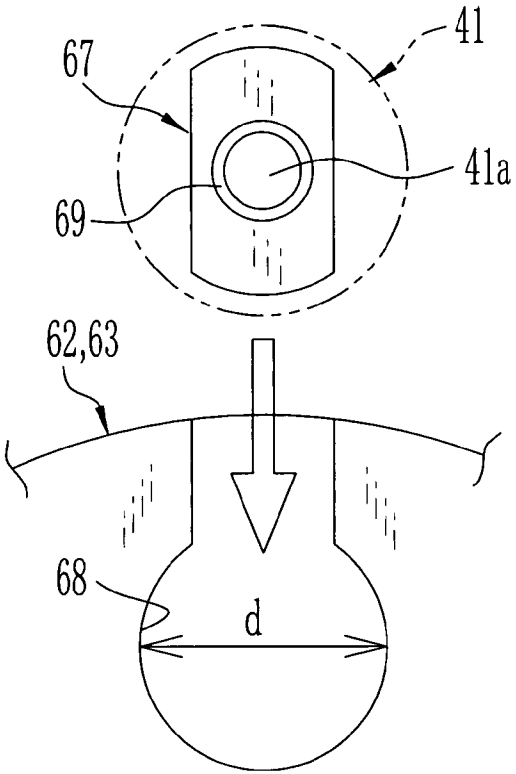
FIGS. 3A, 3B and 3C are explanatory views showing a process for attaching a cleaning roller to an attachment portion.

As shown in FIG. 3, the attachment portion 68 is formed by cutting out a part of the peripheral edge of the first and second rotating plates 62, 63. A cross-sectional surface of the attachment portion 68 has an approximately bottle-shape, and the width of the entrance is narrow, while the bottom portion is widened to have a round shape. The cross-sectional view of the bearing member 67 has an approximately rectangle shape, and its short sides have a circular arc shape according to the curvature of the bottom portion of the attachment portion 68. As shown in FIG. 3A, in order to insert the bearing member 67 in the attachment portion 68 so that its longitudinal direction is directed vertically, the width in its short-side direction corresponds to the width of the entrance of the attachment portion 68 and the length in its long-side direction corresponds to the inside diameter d of the bottom portion of the attachment portion 68.

Figure 3B:
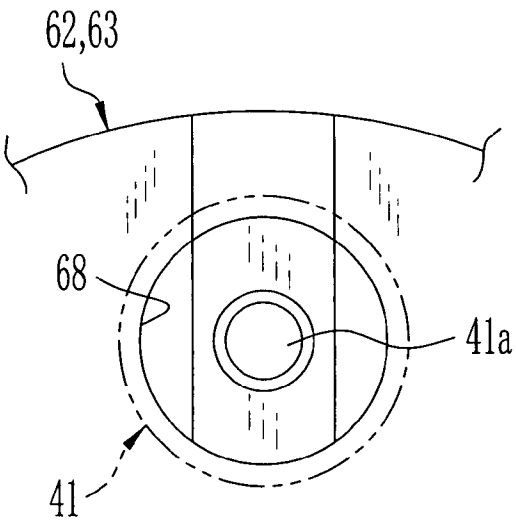
Figure 3C:
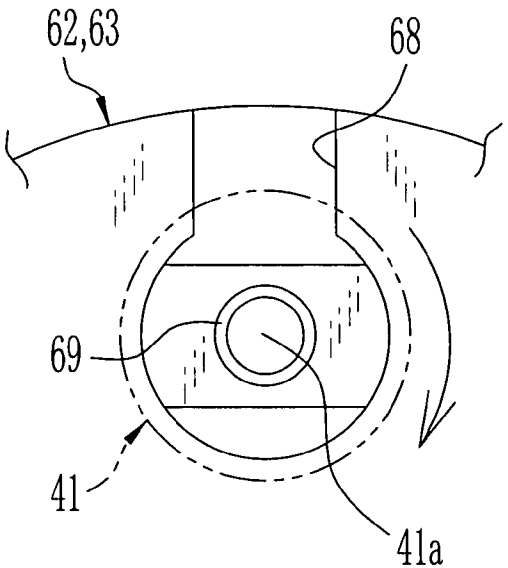

The procedure for attaching the cleaning roller 41 to the first and second rotating plates 62, 63 is explained. Firstly, as shown in FIG. 3A, the bearing member 67 is inserted into the attachment portion 68 such that the longitudinal direction thereof which is directed vertically. Secondly, as shown in FIG. 3B, one end of the bearing member 67 is in contact with the deepest part of the attachment portion 68. Finally, as shown in FIG. 3C, the bearing member 67 is rotated. The inside diameter d is determined such that the bearing member 67 is firmly fitted in the attachment portion 68. Accordingly, the bearing member 67 attached to the attachment portion 68 is not rotated to disconnect improperly from the rotating plates 62, 63. Note that an E-ring or the like may be used so that the rotating shaft 41*a* is not disconnected improperly from the rotating plates 62, 63.

A gear 62*a* meshing with a driving gear 72 is formed on the outer peripheral surface of the first rotating plate 62. Thereby, if the shifting motor M3 is rotated, the rotation is transmitted to the first rotating plate 62 through the driving gear 72. The cleaning roller 41 and the platen roller 23 are selectively positioned to the facing position by the rotation of the first rotating plate 62.

The driving gear 42 is provided in the one end of the main shaft 61 penetrating the first rotating plate 62. The rotation power of the cleaning motor M2 is transmitted to the driving gear 42. In addition, a transmitting gear 74 for transmitting the rotation power to the cleaning roller 41 is provided in the main shaft 61, inside the first rotating plate 62. The transmitting gear 74 rotates the cleaning roller 41 by meshing with a driving gear 76 provided in the rotating shaft 41*a*.

Figure 4A:
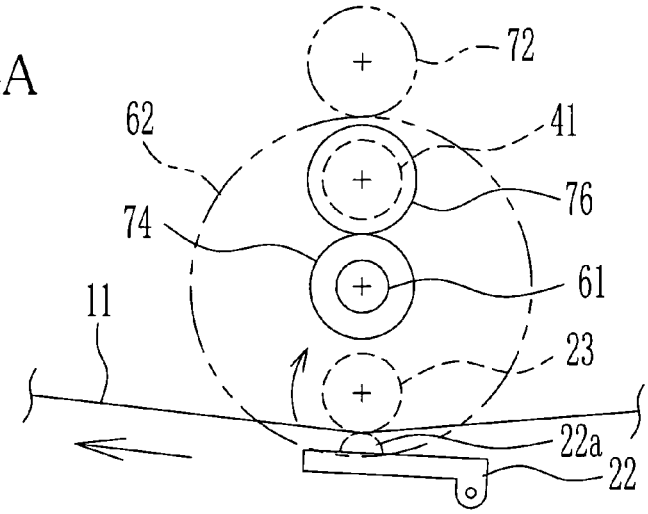
FIG. 4A is an explanatory view showing each position of the cleaning roller and the thermal head in printing.

The operation of the above embodiment is explained by referring to FIG. 4. As shown in FIG. 4A, when printing, the platen roller 23 is positioned at the facing position. In this state, the printing is performed by the thermal head 22 while the recording paper 11 is fed.

Figure 4B:
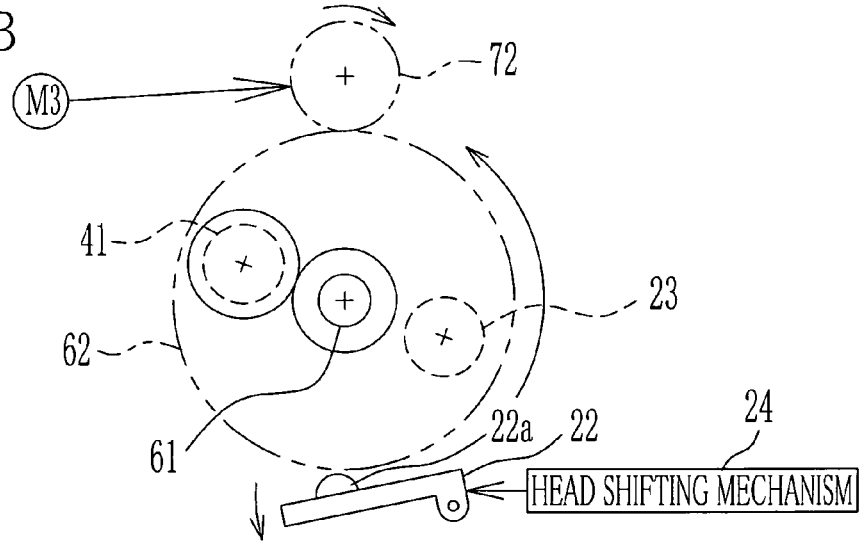
FIG. 4B is an explanatory view showing each position of the cleaning roller and the thermal head in switching a mode.
Figure 4C:
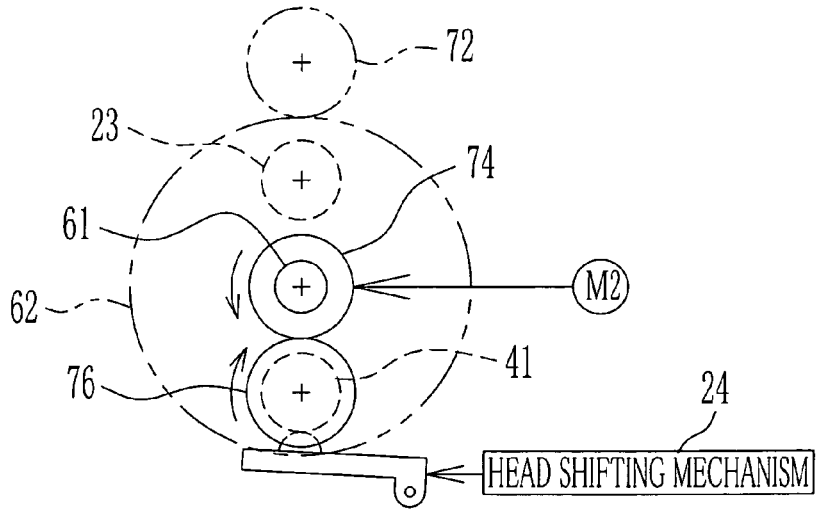
FIG. 4C is an explanatory view showing each position of the cleaning roller and the thermal head in cleaning the thermal head.
Figure 5:
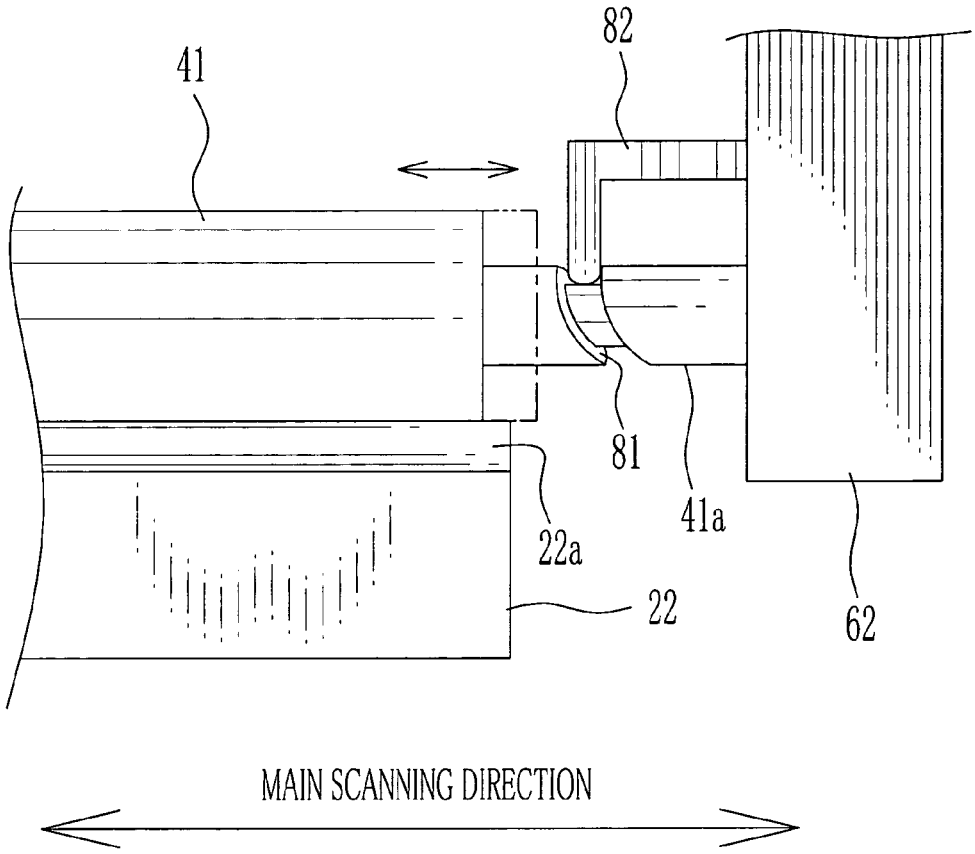
FIG. 5 is an explanatory view showing an embodiment that the cleaning roller is moved back and forth in a main scanning direction.

When the printed sheet number reaches the predetermined number, the operating mode is changed to the cleaning mode. As shown in FIG. 4B, in the cleaning mode, the head shifting mechanism 24 is activated to shift the thermal head 22 to the retracted position. Subsequently, when the shifting motor M3 is rotated, the rotation power is transmitted to the first rotating plate 62 through the driving gear 72 to rotate the first rotating plate 62, so that the platen roller 23 is retracted from the facing position while the cleaning roller 41 is moved thereto. Thereafter, as shown in FIG. 4C, the thermal head 22 is shifted to the pressing position by the head shifting mechanism 24, so that the heating element array 22*a* and the outer peripheral surface of the cleaning roller 41 are contacted with each other.

Subsequently, the cleaning motor M2 starts to rotate. The rotation of the cleaning motor M2 is transmitted to the driving gear 42 to rotate the main shaft 61. The rotation of the main shaft 61 is transmitted to the cleaning roller 41 through the transmitting gear 74. Then the cleaning roller 41 is rotated such that its outer peripheral surface is rubbed against the heating element array 22*a*, so that the foreign matters on the thermal head 22 are scraped off. The cleaning is finished after the cleaning roller 41 has been rotated f or a predetermined period. After that, the roller shifting mechanism 44 shifts the platen roller 23 to the facing position, and the operating mode is returned to the print mode.

In the above embodiment, the cleaning roller 41 is rotated at the predetermined position in the main scanning direction; however, it may be rotated with being moved back and forth along the main scanning direction. Thereby, it is possible to prevent cleaning unevenness which occurs due to unevenness of the peripheral surface of the cleaning roller 41 or other factors, so that a higher cleaning effect can be obtained. In this case, for example, a cam groove 81 is formed in the end of the rotating shaft 41*a* of the cleaning roller 41, and a cam 82 engaging with the cam groove 81 is provided in the second rotating plate 62. When the cleaning roller 41 is rotated, the cleaning roller 41 is moved back and forth in the main scanning direction according to the shape of the cam groove 81. In this case, it is necessary to ensure the thickness of the attachment portion 68 so that the opposite ends of the rotating shaft 41*a* can project from the bearing member 67.

In the above embodiment, although the arrangement angle between the cleaning roller and the platen roller is 180 degrees, it may be any angle for selectively positioning one of these two rollers to the facing position by rotating the first and second rotating plates. For instance, 60 degrees or 90 degrees can be arbitrarily selected as the arrangement angle.

In the above embodiment, the polishing agent is applied on the outer peripheral surface of the cleaning roller; however, the outer peripheral surface may be formed into a brush-like shape, instead of applying the polishing agent. Plastic or metal is used as the material for the brush.

Moreover, although the roller shifting mechanism is driven by the motor in the foregoing embodiment, a shifting lever which can be operated from outside the printer may be provided to shift the rollers.

Furthermore, the color thermal printer is explained in the above embodiment; however, the present invention may be applied to another thermal printer such as the thermal transfer type printer.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal printer comprising:

a thermal head for thermally recording an image by adding heat to a recording material;

a platen roller for supporting said recording material at a facing position to face said thermal head;

a cleaning roller for cleaning said thermal head by rotating in a state that an outer peripheral surface of said cleaning roller is contacted with said thermal head at said facing position;

a roller driving mechanism for driving said cleaning roller; and a shifting mechanism for selectively positioning either one of said platen roller and said cleaning roller at said facing position by shifting both of said rollers.

2. A thermal printer as claimed in claim 1, wherein said shifting mechanism includes first and second rotating plates for supporting both ends of said platen roller and said cleaning roller and a main shaft to which said first and second rotating plates are attached, said first and second rotating plates are rotated around said main shaft.

3. A thermal printer as claimed in claim 2, wherein said cleaning roller is supported by said first and second rotating plates in a detachable manner.

4. A thermal printer as claimed in claim 3, wherein said ends of said cleaning roller is rotatably supported by bearing members, and said first and second rotating plates have attachment portions in which said bearing member is fitted.

5. A thermal printer as claimed in claim 4, wherein said attachment portion has an entrance having narrow width and a round portion having a diameter larger than said entrance, and said bearing member has a pair of parallel end surfaces and a pair of circular-arc end surfaces, distance between said parallel end surfaces corresponding to width of said entrance, while distance between said circular-arc end surfaces corresponding to said diameter of said round portion.

6. A thermal printer as claimed in claim 2, wherein said shifting mechanism further comprises:

a gear provided in an outer peripheral surface of said first rotating plate;

a driving gear meshing with said gear; and a first motor for rotating said driving gear.

7. A thermal printer as claimed in claim 2, further comprising bearings, for making said main shaft rotatable around an axis thereof, provided between said main shaft and said first and second rotating plates.

8. A thermal printer as claimed in claim 7, wherein said roller driving mechanism comprises:

a roller driving gear provided in said cleaning roller;

a transmission gear, provided in said main shaft, for meshing with said roller driving gear;

a shaft driving gear provided in said main shaft; and a second motor for rotating said shaft driving gear.

9. A thermal printer as claimed in claim 8, wherein said roller driving mechanism further comprises:

a cam groove provided in said cleaning roller; and a cam pin, provided in said second rotating plate to engage with said cam groove, for moving said cleaning roller back and forth in an axis direction.

10. A thermal printer as claimed in claim 1, further comprising:

a sheet counter for counting printed sheet number; and a controller for controlling operation of said shifting mechanism and said roller driving mechanism, which drives these mechanisms when said sheet counter completed counting predetermined printed sheet number.

11. A thermal printer as claimed in claim 1, wherein said outer peripheral surface of said cleaning roller is coated with polishing agents.

12. A thermal printer as claimed in claim 1, wherein said outer peripheral surface of said cleaning roller has a brush-like shape.

13. A cleaning method for a thermal head of a thermal printer comprising the steps of:

positioning a cleaning roller at a facing position to face said thermal head with retracting a platen roller from said facing position; and cleaning said thermal head by rotating said cleaning roller by a roller driving mechanism in a state that said cleaning roller is contacted with said thermal head.

14. A cleaning method for a thermal head as claimed in claim 13, wherein said cleaning step is executed automatically at a predetermined timing.

15. A cleaning method for a thermal head as claimed in claim 14, wherein said cleaning step is executed when printed sheet number reaches a predetermined number.

16. A cleaning method for a thermal head as claimed in claim 14, wherein said cleaning step is executed when said thermal printer is powered on.

17. A cleaning method for a thermal head as claimed in claim 14, wherein said cleaning step is executed by instruction from a host computer connecting with said thermal printer communicably.

18. A cleaning method for a thermal head as claimed in claim 13, wherein said cleaning step is executed when a user operates an operating unit provided in said thermal printer.

* * * * *